United States Patent [19]

Bruckner et al.

[11] Patent Number: 4,932,335

[45] Date of Patent: Jun. 12, 1990

[54] COAL COMBUSTION WITH A FLUIDIZED INCINERATION BED

[75] Inventors: Hermann Bruckner, Uttenreuth; Lotbar Stadie, Hochstadt; Gerhard Scholl, Spicsen-Elversberg; Karl-Ewald Stoll, Saarbrucken, all of Fed. Rep. of Germany

[73] Assignee: Saarbergwerke Aktiengesellschaft, Saarbrucken, Fed. Rep. of Germany

[21] Appl. No.: 250,718

[22] PCT Filed: Jan. 21, 1988

[86] PCT No.: PCT/EP88/00043

§ 371 Date: Oct. 31, 1988

§ 102(e) Date: Oct. 31, 1988

[87] PCT Pub. No.: WO88/05494

PCT Pub. Date: Jul. 28, 1988

[30] Foreign Application Priority Data

Jan. 22, 1987 [DE] Fed. Rep. of Germany ..... 3701798
Oct. 7, 1987 [DE] Fed. Rep. of Germany ..... 3733831

[51] Int. Cl.[5] ..... F23B 7/00

[52] U.S. Cl. ..... 110/234; 110/245; 110/205; 122/2; 122/4 D; 122/7 R

[58] Field of Search ..... 110/245, 205, 234, ; 122/4 D, 7 R

[56] References Cited

U.S. PATENT DOCUMENTS

| | | | |
|---|---|---|---|
| 4,355,601 | 10/1982 | Hattiangadi | 110/245 X |
| 4,509,437 | 4/1986 | Breidenbach et al. | 110/205 X |
| 4,628,833 | 12/1986 | O'Hagan et al. | 110/245 X |
| 4,656,972 | 4/1987 | Shimoda | 110/205 X |
| 4,676,177 | 6/1987 | Engstrom | 110/245 X |

*Primary Examiner*—Edward G. Favors
*Attorney, Agent, or Firm*—James Creighton Wray

[57] ABSTRACT

According to a process for the combustion of organic substances, such as domestic or industrial waste and the like, in a fluidized incineration bed (1) at a mean combustion temperature of 800° C., the flue gased emitted by the fluidized bed (1) are heated with the associated flue dust to a temperature of at least 900° C., preferably 1000° C. to 1200° C., in a subsequent combustion zone (23), in order to destroy toxic substances are burnt. To this effect, the flue gases are introduced in the incinerating chamber of an industrial furnace, for example a steam generator (2) of a coal-operated power plant. By connecting in the gas supply line a fluidized bed (1) upstream of a steam generator (2) fired with coal, a substantial reduction in NOx formation is achieved.

21 Claims, 2 Drawing Sheets

COAL COMBUSTION WITH A FLUIDIZED INCINERATION BED

Figure 1:
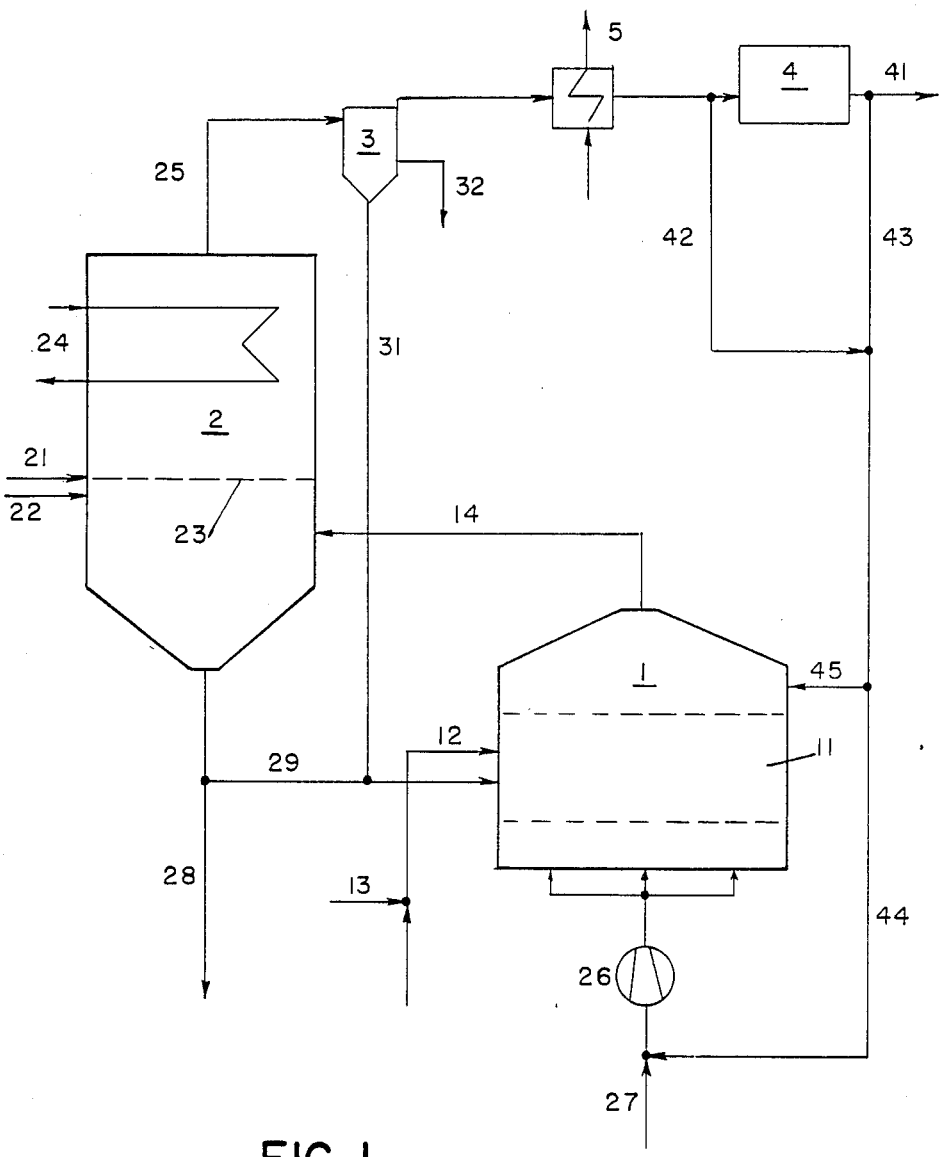

The invention concerns a process for the combustion of coal and/or waste products containing organic substances, such as domestic and industrial waste and the like, by using fluidized bed combustion with a median combustion temperature of approximately 800° C., as well as a furnace for the implementation of the process.

For a considerable time fluidized bed combustion units of the most varied implementation types have been part of the state of technology. Their main advantages may be found in the circumstance that, in contrast to other types of combustion units, one can also burn lower grade fuels with a high contents of ballast, such as, for example, ballast coal or processing waste materials, which are generated as by-products during the processing of bituminous coal, or other organic substances, in particular, domestic and/or industrial waste and similar materials with the most varied compositions.

One advantage of fluidized bed combustion units consists in their relative low environmental pollution effects, since at the relatively low combustion temperatures of approx. 800° C. the production of nitrogen oxides, (or of other toxic substances, such as sulfur oxides), is low due to the addition of appropriate absorption agents, such as limestone. To a great extent this makes it possible to bind these toxic substances within the fluidized bed combustion unit. Beyond this, fluidized bed combustion units have the positive characteristic of a homogeneous temperature distribution within the fluidized bed, so that, particularly when burning waste materials consisting of less homogeneous organic substances, such as domestic waste or industrial waste, favorable combustion is ensured.

In contrast to the above, the emission of toxic substances from traditional steam generation plants with a coal operated steam generator without post-treatment of the flue gases, that is, without secondary measures, generally exceeds the limits established by the legislature. The secondary measures known to be used for this purpose, such as dust removal units, devices to remove sulfur from flue gases and DENOX catalysts, considerably increase investment and operational costs.

Thus, we have established the objective of reducing the emission of toxic substances with the aid of so-called primary measures that concern the combustion unit itself, such as by using NOx-poor burners, or with the aid of fluidized bed combustion units equipped with heat exchanger surfaces.

However, it is unfavorable that the heat exchanger surfaces within fluidized bed combustion units are exposed to increased corrosion and erosion effects. During the combustion of waste matter containing organic substances, such as domestic and industrial waste and the like, due to the relatively low combustion temperatures the fluidized bed has restrictions imposed upon it if the substances to be burned contain organic or inorganic chloride compounds, for example, polychlorated biphenyls (PCB), since in this case highly toxic dioxins, such as polychlorated dibenzodioxin (PCDD) or polychlorated dibenzofuranes (PCDF), may be generated.

The invention is based on developing a process and a unit which, on one hand, will prevent the formation of highly toxic dioxins during the combustion of waste products containing organic substances, and on the other hand, when burning coal, it will also ensure that relative large amounts of nitrogen oxides will not be produced to start with, so that the DENOX units used for flue gas post-processing will become superfluous.

According to the invention, this task is solved by heating the flue gases exiting the fluidized bed combustion unit, together with the airborne dust, to a temperature of at least 900° C. in a heating area. Thus, with the aid of the invention it becomes possible to deactivate highly toxic dioxins which, as is known, are generated at temperatures above 900° C., especially at temperatures between 1,000° C., and 1,200° C., and to convert them into non-toxic organic substances.

The heating of the flue gases generated in the fluidized bed combustion unit to a temperature of at least 900° C. can also be accomplished with the aid of direct heat (for example, by mixing with a hot gas), or by indirect heat addition with an appropriate heat exchanger.

However, it has been especially advantageous to feed the hot flue gases from the fluidized bed directly into the combustion chamber of a new, or already existing industrial boiler, for example, the boiler of a steam generator in a coal operated power plant. Thus, the existing infrastructure of such a boiler unit with its heat exchanger surfaces, as well as with the flue gas dust removal and flue gas cleansing devices, can be fully utilized to transfer the heat from gases emanating from the fluidized bed. Besides, it can be ensured that, due to the high combustion temperatures of such industrial boiler units, the dioxins borne within the flue gases escaping from the fluidized bed combustion unit will converted into harmless substances. According to the invention the waste products to be burned can also be mixed with other organic substances, for example, bituminous coal or brown coal, in which case the total amount of generated flue gases will be heated to a minimum temperature of 900° C. Such an implementation should always prove to be favorable in those cases in which a large fluidized bed unit already exists on site.

As a rule, a fluidized bed combustion unit according to the invention is used within the fluidized bed without immersion heating surfaces, that is, without heat exchanger surfaces, and temperature regulation is accomplished by adjusting the reaction of the materials.

In a coal operated generator primary NOx emissions can be reduced even more by installing a fluidized bed combustion unit upstream, than it would be possible with any of the other known processes. The utilization of a fluidized bed chamber without built-in heat exchanger surfaces makes it possible to work with a reducing (oxygen poor) fluidized bed, without having to worry about the cooling of the fluidized bed. Also, the cooling of the containment walls may be omitted. Thus, the generation of nitrogen oxides can be further reduced.

The generated heat is extracted from the fluidized bed combustion unit by way of the flue gases and can be transmitted to a double circuit, or to any other type of heat consuming unit, for example, an industrial boiler placed downstream, together with the heat generated there. When the temperature is adjusted to a constant level of, say, 800° C. within the fluidized bed combustion unit, it has proven to be effective to reintroduce, as a cooling agent, a segment of the cooled (and possibly already cleaned) flue gases from the industrial boiler located downstream, back into the fluidized bed combustion.

According to a further characteristic of the invention, the cooling of the fluidized bed combustion unit can also be accomplished by the fluidized bed material which is continuously fed into it. If the fluidized bed combustion unit is operated in combination with the steam generator of a power plant, it has been proven to be advantageous to utilize the coarse ash generated in the steam generator boiler as fluidized bed material. Following the trituration of the coarse ash by friction, it is extracted as airborne ash together with the flue gases. This mode of implementation has the advantage, that not only the flue gases, but also the bed ashes are introduced into the steam generator placed downstream. Inside the steam generator these materials are exposed to the elevated target temperatures, so that toxic components cannot be expelled from the fluidized bed combustion unit.

Instead of using coarse ash from the power plant boiler as fluidized bed material, one can also use part of the raw airborne ash collected in the electric filter of the power plant.

In the event of using organic waste products as fuel, and if there is no heat source or no industrial boiler available for the high temperature treatment of the flue gases and of the airborne ash generated in the fluidized bed, according to the additional characteristic of the invention, it is also possible to only partially burn the waste materials to CO (that is, to convert them into gases) within the fluidized bed with the aid of a small addition of air. The gasification product containing CO is then burned to $CO_2$ at correspondingly high temperatures in a combustion unit placed downstream. Also, in this case it is possible to convert the toxic dioxins contained in the gasification product of the fluidized bed combustion unit into harmless materials.

Figure 2:
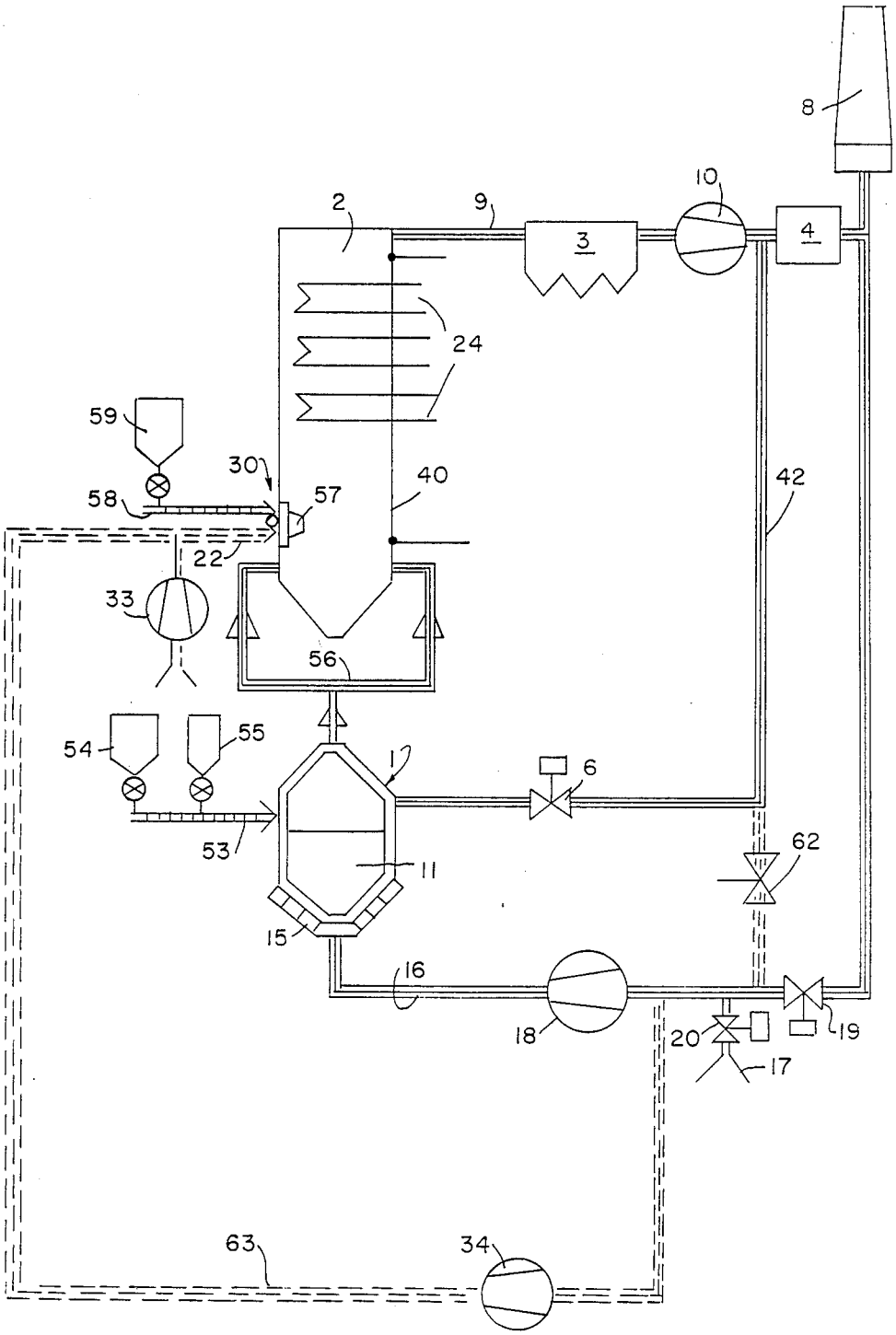

Further details regarding the invention can be extracted from FIGS. 1 and 2 of the schematically illustrated implementation examples. Shown are:

FIG. 1: A combustion unit according to the invention for the combustion of, in particular, waste products containing organic substances.

FIG. 2: A combustion unit according to the invention illustrated with the example of a steam generation unit.

FIG. 1 schematically shows a fluidized bed combustion unit 1 with a fluidized bed 11, into which organic waste products are fed in by way of pipe 12. Coal may be also added to the fuel by way of pipe 13. The materials are burned at a median temperature of approx. 800° C.

In the example illustrated in FIG. 1, on the flue gas side a coal dust 21 operated steam generator 2 (fed with fresh air 22) of the type found in power plants, has been configured downstream from the fluidized bed combustion unit 1. Below the firing zone 23, the flue gases, including airborne flue and ash particles, are introduced into the steam generator 2 by way of pipe 14. During the subsequent flow through the firing zone 23 of steam generator 2 the introduced flue gases from the fluidized bed combustion unit 1 are heated to temperatures above 900° C., preferably to temperatures between 1,000° C. and 1,200° C. During this process the toxic substances possibly generated in the fluidized bed 1 and borne by the flue gases, such as dioxins, are destroyed. After having transferred most of their heat to the water to be converted into steam by way of heat exchanger 24, the mixed flue gases from the fluidized bed combustion unit 1 and from the steam generator 2 are extracted by way of pipe 25, have the dust removed by an electric filter 3 and are then possibly further cooled in a heat exchanger 5. These gases are then cleaned in a flue gas wash 4, and most of the flue gases are then expelled into the atmosphere by way of pipe 41.

A segment of the flue gases is branched off (by pipe 42 placed upstream from the flue gas wash 4, or via pipe 43 following the flue gas wash) and is fed back into the fluidized bed 11 by way of pipe 44 with the aid of a pressure blower 26, together with fresh air suctioned via pipe 27. During this process the target combustion temperature of approx. 800° C. for the fluidized bed combustion unit 1 can be sustained by adjusting the amount of the aspired fresh air and of the recirculated flue gases. In order to limit the flow velocity inside fluidized bed 11, it may be advantageous to introduce, via pipe 45 located above the fluidized bed 11, part of the fed-back and cooled flue gases exclusively for the purpose of extracting heat from the fluidized bed combustion unit 1.

The coarse ashes are removed from the ashes extracted from steam generator 2 via pipe 28 and are fed back into the fluidized 11 bed as bed material. Due to the friction within fluidized bed 11 the coarse ashes are gradually reduced in size and are dragged along as airborne dust, together with the flue gases, and are introduced into the steam generator 2. Also, the coarse ash component may be separated from the airborne ash extracted from the electric filter 3 and may be reintroduced into the fluidized bed 11 by way of pipes 31 and 29. The medium and small ash kernels are extracted with the aid of pipe 32.

FIG. 2 schematically shows an example of a steam generator according to the invention. This unit consists of a steam generator 2, which in the implementation example has been equipped with a coal dust combustion system 30. The containment walls 40 of the steam generator 2 have been configured as finned pipe walls, and have been connected in a common manner together with the remaining steam generator 2 heat exchanger surfaces 24 to a water circuit not shown in further detail. A dust filter 3, a suction fan 10, and a flue gas sulfur removal device 4 have been connected to the flue gas pipe 9 exiting the steam generator 2 and leading into the chimney 8.

A fluidized bed combustion unit 1 with a stationary fluidized bed 11 has been configured on the gas side of steam generator 2. The tuyere bottom 15 is connected to a gas pipe 16, one branch of which is connected to the flue gas pipe 9 leaving the flue gas sulfur removal device 4, and the other branch is connected to a fresh air aspiration opening 17.

Inside gas pipe 16 a gas compressor 18 has been installed to generate the necessary gas pressure differential for the tuyere bottom 15. The branch of gas pipe 16 leading to the flue gas pipe 9, and also the branch leading to the fresh air aspiration opening 17, have been equipped with dosage valves 19, 20. Further, above the stationary fluidized bed 11, the fluidized bed combustion unit 1 has been connected with the flue gas pipe 9 via an additional gas pipe 42. This pipe branches off from the flue gas pipe 9 immediately following suction fan 10. This additional gas pipe has also been equipped with a dosage valve 6. Additionally, the fluidized bed combustion unit 1 has been connected to a fuel supply line 53, which, in turn, has been connected to a coal bunker 54 and to a lime bunker 55.

The exhaust gas pipe 56 for the fluidized bed combustion unit 1 ends within the lower section of the steam generator 2. Above the plane of the admission openings for the exhaust pipes 56 of fluidized bed unit 1, inside steam generator 2, burner 57 for a coal dust firing unit 30 has been installed in the containment wall 40 of the steam generator 2. Burner 57 has been connected to the coal bunker 59 and a fresh air pipe connects to a fresh air blower 33.

In addition to the above, it is possible to connect both gas pipes 16, 42 via a shunt pipe 62 (shown with a dashed line). Also, the steam generator unit may be equipped with an auxiliary pipe 63 (also shown with a dashed line), which on one end connects with the gas pipe 16 placed immediately prior to the gas compressor 18, and which connects the pipe 16 with the steam generator 2 fresh air pipe 22. A smoke blower 34 has been installed inside auxiliary pipe 63.

During the operation of the steam generator unit finely ground coal is extracted from the coal bunker 59 and is fed into the burner 57, together with the fresh air provided by the fresh air blower 33. The hot flue gases generated by the combustion process flow through the steam generator 2 and heat up the containment walls 40, and the heat exchanger surfaces 24 leading into the steam generator 2, and leave the steam generator 2 with a strong cooling effect by way of flue gas pipe 9. The dust particles are trapped inside the dust filter 3 connected to the flue gas pipe 9 (in the implementation example an electric filter). The dust-free flue gases exiting the dust filter 3 are impelled into the flue gas sulfur removal device 4 by means of suction blower 10 and the sulfur components are removed while the remainder is expelled into the chimney 8.

Flue gas is suctioned by the gas compressor 18 from the gas pipe 16 that branches off between flue gas pipe 9 between the flue gas sulfur removal device 4 and the chimney 8. This gas is forced through the tuyere bottom 15 of the fluidized bed combustion unit 1. The gas has been mixed with fresh air that entered by way of the fresh air opening 17. The necessary mixture ratio, that is, the necessary oxygen contents, can be regulated by dosage valves 19, 20, that have been installed within the fresh air inlet opening 17 and within the branches of gas pipe 16 connecting with the flue gas pipe 9. The fluidized bed combustion unit 1 receives finely ground coal and a predetermined amount of lime by way of fuel supply line 53. The coal particles introduced into the fluidized bed combustion unit 1 are oxidized in the fluidized bed 11, where, above all, carbon monoxide is generated due to the sub-stoichiometric addition of oxygen. The sulfur contained in the fuel is bound to gypsum in the fluidized bed 11 by the lime mixed into the coal, and is eliminated together with the ash in a fashion not described in further detail. Before it can be bound, the required oxidation of sulfur limits the extent of the sub-stoichiometric addition of oxygen within fluidized bed 11. Above fluidized bed 11 the formation of nitrogen oxides can not only be halted by the addition of large amounts of flue gases through the auxiliary gas pipe 42, but also, the already formed nitrogen oxides can be reduced within a small measure. Additionally, the temperature in the fluidized bed combustion unit 1 can be lowered by adding cooler flue gases, and in this way it is possible to reduce the formation rate of nitrogen oxides even further.

In order to keep the temperature in the fluidized bed 11 at the lowest possible values the fluidized bed combustion unit 1 has been implemented without heat exchanger surfaces. This makes it possible to avoid local temperature drops within fluidized bed 11, from which an extinguishing of the reaction in fluidized bed 11 could be otherwise initiated. Finally, the introduction of flue gases via auxiliary line 42 produces the effect of considerably reducing the calorific value of the fluidized bed combustion unit 1 exhaust gases, which are fed into the steam generator 2 through the exhaust gas line 56. This, in turn, leads to a lower combustion temperature of the gases within the steam generator 2, and also reduces the formation of nitrogen oxides there. The coal dust burner 57 in itself is the prerequisite for the improved mixing of flue gases emanating from steam generator 2 with the exhaust gases of the fluidized bed 1, since without the coal dust burner 57 flame the exhaust gas from the fluidized bed combustion unit 1, which is extremely poor in calorific value, added by line 56, could not burn effectively in the steam generator.

The shunt line 62 makes it possible to mix flue gases at will for the fluidized bed combustion unit 1. These flue gases can be extracted with a higher temperature before they reach the sulfur removal device 4 of flue gas line 9, or they can be extracted with a slightly lower temperature downstream from the sulfur removal device 4. Beyond those measures described above, this provides additional means for the adjustment of the temperature within the fluidized bed combustion unit 1. Finally, the flame temperature of the coal dust burner 57 for the steam generator 2 can be reduced by adding flue gases to the fresh air via auxiliary line 63. For this purpose an additional smoke blower 34 has been installed inside auxiliary line 63 that branches off before reaching gas compressor 18.

It is an advantage of this steam generating unit that, within the fluidized bed combustion unit 1 placed upstream from it, a large proportion of the sulfur contents can be bound to gypsum by the addition of lime, which can then be removed together with the ash of the fluidized bed combustion unit 1. This process reduces the complexity and cost required for the removal of sulfur from the flue gases. If a different type of coal with a lower sulfur contents is used for the coal dust bunker 59, then one may approximate the limit values established by the legislature, even without the use of a flue gas sulfur removal unit. Further, the sub-stoichiometric combustion in the fluidized bed combustion unit 1, and the addition of cooled flue gases by way of auxiliary line 42, lowers the temperature in the fluidized bed 11 to values at which nitrogen oxides can hardly be generated. Due to the fact that the fluidized bed combustion unit 1 has been implemented without cooled containment walls, and without heat exchanger surfaces, local temperature drops within fluidized bed 11 are avoided, and these lower temperatures reduce the danger of a local undercooling of he fluidized bed 11, since undercooling might have the effect of extinguishing the same. Beyond this, the formation rate of nitrogen oxides in the fluidized bed combustion unit 1 is also additionally reduced by the circumstance that fresh air is added to the fluidized bed combustion unit 1 in a sub-stoichiometric quantity. This oxygen insufficiency is an additional factor that aids in the prevention of the formation of nitrogen oxides. The gases leaving the fluidized bed combustion unit 1 (which mainly consist of carbon monoxide) which have received additional flue gases to reduce their calorific value by way of another gas line, burn in the atmosphere with the oxygen contents of steam generator 2 at a relatively low temperature, so that, in this case, nitrogen oxides are barely generated within the steam generator 2. Finally, the coal dust burner 57 flame in steam generator 2, which also burns the exhaust gases of fluidized bed combustion unit 1, is cooled by the addition of flue gases from auxiliary line 63, so that nitrogen oxides are hardly generated at this point.

The operational conditions for the steam generator 2 are adjustable within wide ranges due to the fluidized bed configured upstream from the steam generator 2 and by the installation of the individual gas lines 16, 42 leading to the fluidized bed combustion unit 1. This also makes it possible to utilize the advantages of both individual firing systems to a greater extent, thus suppressing the formation of nitrogen oxides in a primary manner, and in such a way, that it is possible to comply with the emission regulations even without a DENOX unit.

We claim:

1. Process for the combusion of coal and/or organic substances, like home garbage, industrial refuse and similar matter, utilizing a fluidized bed combustion unit with a medium combustion temperature of approximately 800° C., comprising the step of introducing into a combustion chamber of a steam generator, flue gases exiting from the fluidized bed combustion unit, together with airborne coal dust.

2. The process of claim 1, further comprising the step of combusting the combined flue gases exiting from the fluidized bed combustion unit and the airborne coal dust after introducing these into the combustion chamber of the steam generator.

3. The process of claim 1, further comprising the step of mixing the flue gases with fresh air after entering the steam generator.

4. The process of claim 1, further comprising the step of continuously reintroducing, following cooling and possible cleaning, part of the flue gases leaving the steam generator back into the fluidized bed combustion unit.

5. The process of claim 1, wherein bedding for the fluidized bed combustion unit utilizes coarse ashes from the steam generator, whereby the coarse ashes, after trituration by friction in the fluidized bed combustion unit, will again be introduced into the steam generator.

6. The process of claim 4, wherein the temperature of the fluid bed combustion unit is regulated by the addition of the cooled and possibly cleansed flue gases from the steam generator.

7. The process of claim 4, further comprising the step of mixing the flue gases with fresh air before entering the fluidized bed combustion unit.

8. The process of claim 7, wherein the temperature of the fluidized bed combustion unit is regulated by the $O_2$-content of the combustion air.

9. The process of claim 4, further comprising the step of burning the flue gases together with coal or a coal mixture in the fluidized bed combustion unit.

10. The process of claim 9, wherein the temperature of the fluidized bed combustion unit is regulated by way of the amount of coal or coal mixture added.

11. The process of claim 9, wherein the temperature of the fluidized bed combustion unit is regulated by way of the calorific value of the added coal or added coal mixture.

12. The process of claim 4, further comprising the step of compressing the flue gases with a flue gas compressor to a gas pressure of the stage following a fresh air blower.

13. The process of claim 4, further comprising the step of reintroducing an additional source of flue gases leaving the steam generator back into the fluidized combustion unit following cooling and possible cleansing.

14. The process of claim 13, wherein the introduction of the additional flue gases into the fluidized bed combustion unit occurs above the fluidized bed.

15. A combustion unit for a power plant comprising an integrated, coal heated steam generator, a fresh air blower, a dust removal device and a device for removal of sulfur from flue gases, and on a gas side of the steam generator, a fluidized bed combustion unit without built-in heat exchange heating surfaces, wherein the fluidized bed combustion unit is connected to the steam generator, and wherein the operating temperature of the fluidized bed combustion unit is regulated by adjusting reaction materials introduced into the fluidized bed.

16. The combustion unit of claim 10, wherein the fluidized bed combustion unit is constructed without cooled containment walls.

17. The combustion unit of claim 15, further comprising a first gas line which branches off from a flue of the steam generator at a point downstream from the flue gas sulfur removing device.

18. The combustion unit of claim 17, further comprising a second gas line which branches off from the flue of the steam generator prior to the sulfur removing device and connects to the fluidized bed combustion unit, wherein flue gases are added to the fluidized bed combustion unit.

19. The combustion unit of claim 18, wherein the second gas line connects to the fluidized bed combustion unit above the fluidized bed.

20. The combustion unit of claim 17, further comprising a fresh air aspiration opening in the first gas line, wherein the flue gases are mixed with fresh air before entering the fluidized bed combustion unit.

21. The combustion unit of claim 17, further comprising a flue gas compressor, wherein the flue gases are compressed to a gas pressure of the stage following the fresh air blower.

* * * * *

UNITED STATES PATENT OFFICE

CERTIFICATE OF CORRECTION

Patent No. 4,932,335 Dated June 12, 1990

Inventor(s) Bruckner et al.

It is certified that error appears in the above-identified patent and that said Letters Patent is hereby corrected as shown below:

On the cover, kindly note as the assignee:

Saarbergwerke Aktiengesellschaft, Saarbrücken and Siemens Aktiengesellschaft, Munich, Federal Republic of Germany

Signed and Sealed this

Fifteenth Day of October, 1991

*Attest:*

HARRY F. MANBECK, JR.

*Attesting Officer*

*Commissioner of Patents and Trademarks*